US007520233B1

(12) United States Patent
Lyon

(10) Patent No.: US 7,520,233 B1
(45) Date of Patent: Apr. 21, 2009

(54) CLEAT-ROD APPARATUS

(76) Inventor: David M. Lyon, 2535 Sun Cove La., Palm Beach Gardens, FL (US) 33410

( * ) Notice: Subject to any disclaimer, the term of this patent is extended or adjusted under 35 U.S.C. 154(b) by 0 days.

(21) Appl. No.: 11/888,430

(22) Filed: Aug. 1, 2007

Related U.S. Application Data

(60) Provisional application No. 60/821,239, filed on Aug. 2, 2006.

(51) Int. Cl.
*B63B 21/04* (2006.01)

(52) U.S. Cl. ..... 114/218

(58) Field of Classification Search ..... 114/218, 114/219, 343, 364; 24/129 R, 130, 135 R; 410/101
See application file for complete search history.

(56) References Cited

U.S. PATENT DOCUMENTS 4,749,230 A * 6/1988 Tornero ..... 297/353
5,662,306 A 9/1997 Dysarz
6,125,779 A 10/2000 Czipri
6,487,984 B1 12/2002 Pape et al.
6,644,230 B1 * 11/2003 Webster ..... 114/218
6,840,186 B1 1/2005 Steele
7,025,012 B1 4/2006 Pecharich
7,188,579 B2 3/2007 Lemonides
7,302,900 B1 * 12/2007 Stefano ..... 114/218

* cited by examiner

*Primary Examiner*—Lars A Olson
(74) *Attorney, Agent, or Firm*—James E. Maslow

(57) ABSTRACT

A cleat-rod apparatus includes a unitary cylindrical rod member which extends and morphs into a cleat member, wherein the cylindrical rod member and cleat member have no parting-line, and wherein the cylindrical rod member is shaped for being snugly received within a fishing rod holder extending generally downward through a boat hull which may be at an angle and into an interior hull space, and further is configured to avoid damaging contact with hull surfaces when the installed cleat-rod apparatus is rotated in the holder.

18 Claims, 4 Drawing Sheets

CLEAT-ROD APPARATUS

This application claims priority based on my U.S. Provisional Patent Application Ser. No. 60/821,239, filed Aug. 2, 2006.

BACKGROUND OF THE INVENTION

1. Field of Invention

The present invention relates generally to boating equipment, and more particularly to a portable boat cleat for attachment to a stern fishing rod holder.

2. Description of the Prior Art

Boat owners endeavor to protect against hard-edged structures being brought abruptly against the boat hull. Fenders are used to avoid damage to the boat hull from such unwanted contact. Extra effort is also required to protect from scarring or other damage of the surface of most modern boats made with fiberglass, plastic or other synthetic material. Such care is essential to preserving the appearance, life and even safety of these boats.

Ordinarily, boats are constructed having cleats permanently attached to an upper surface of the boat hull along the gunwale. Cleat lines can serve to tether a boat to a dock, or can be used to tie off one craft to another (such as a dingy to a larger cruising vessel), or to hang fenders, bait and chum baskets, or the like to and over the side of the boat. Boats often have a small number of cleats, and there are times when additional cleats are desired. Permanent installation of additional cleats is possible. But at times it would be more desirable to provide a boat cleat adapted for being temporarily attached to an existing structure at along the gunwale.

Typically, cleats are either directly accessible or accessible through a hawser in the gunwale. As shown in FIG. 1, a typical sport fishing boat will tie up fore and aft when docking, with a fender 10 tied at the stern and with another fended tied on more forward. Fender 10 is attached by a line 11 to aft cleat 12 via howser 14 in gunwale 16. But there is a risk of having a fender slip off of the beam when tied to such a corner cleat as indicated by arrow 18, risking damage to the side of hull 20.

A portable cleat assembly such as described in U.S. Pat. No. 6,487,984 can be used for attachment of a fender at a location along the hull where a cleat is not readily available and where a fishing rod-holder 22 is available. The '984 patent teaches a portable boat cleat assembly having a cleat fastened to an upper surface of a substantial base plate and a cylindrical rod having an upper end welded to the lower surface of the base plate. The plate and cylinder meet at a right angle or with some light incline and form a substantially T-shaped assembly As shown in FIG. 1, a conventional fishing rod holder 22 features a cylindrical rod-receiving member 24 extending vertically downward through an upper hull surface 26 and reaching into the interior of hull 20. One end of the cylindrical rod of the '984 portable boat cleat assembly is inserted through hull opening 28, the mouth of fishing rod holder 22, and is received within the rod holder cylinder 24. The attached cleat is now ready for attachment of a fender.

Fishing rod holders normally are at an angle to the surface of the hull. Typically the '984 assembly is installed at a slight angle in rod holder 22 and is held in place thereat. This engagement assures that the base plate, typically mounted close to the hull in use, and at an angle, is prevented from rotating and turning into the hull surface and causing damage.

SUMMARY OF THE INVENTION

It is therefore an object of the present invention to provide a safe and portable boat cleat apparatus which can be easily secured to an existing boat hull structure.

It is another object of the present invention to provide a safe and portable boat cleat apparatus which can be easily secured to an existing boat hull structure, and, as installed, may be rotated without risk of hull damage.

It is another object of the present invention to provide a strong, light-weight, cleat-rod apparatus, molded as a single part wherein the rod portion extends up to and morphs into the cleat portion without a parting-line transition.

It is a further object of the present invention to provide a portable boat cleat apparatus that is safe to use and easy to store.

It is another object of the present invention to provide a low-cost, strong, and light-weight cleat-rod apparatus, molded as a single part and having a rod portion and a cleat portion, wherein the cleat-rod apparatus does not have welds or screws or the like securing the cleat and rod portions together.

It is yet another object of the present invention to provide a strong, light-weight, cleat-rod apparatus, molded as a single part wherein the rod portion extends up to and morphs into the cleat portion without a parting-line transition and without a mounting plate.

The present invention meets the need in the art for an easily stored and used, light-weight, inexpensive, robust, portable fender tie-down for use in a fishing rod holder in a boat hull. One embodiment the present invention provides a portable-cleat-rod apparatus to provide a fender-line tie-down for use with a fishing rod holder mounted in a boat hull.

The apparatus preferably has a single-piece cleat-rod, with an integral rod and cleat. In one embodiment the rod has a distal end with an outer dimension for insertion and holding in the rod-receiver, and wherein the cleat is formed as an integral part of the rod. The cleat-rod is a unitary molded part and does not have or need any post-forming fasteners for joining the rod and cleat. If the fishing rod holder is of the type that has a pin at its base, the cleat-rod is preferably provided with a distal end with a part for mating with the pin when the apparatus is installed in the holder. In one embodiment, the cleat and rod are formed as a unitary part without material separation or parting-line transition therebetween.

In one embodiment the cleat-rod can be seated in four positions in the receiver and wherein the cleat shape favors over to one of the directions when the apparatus is seated.

In various embodiments, the tie-down portion forms a cleat, yoke, eyelet or the like preferably in a form that the line cannot unintentionally slide off while still knotted such as by providing it with an opening for passing of a tie-line therethrough for suspension of a fender from the apparatus and along side the exterior of the hull.

In another embodiment, a single-piece fender-line tie-down apparatus has an elongate substantially cylindrical part with a shaped end, the part forming a cylindrical mounting portion with a tie-down portion at the shaped end. The mounting portion is for temporary and removable engagement within a fishing rod-receiver with the mounting portion extending below the hull surface and with the tie-down portion being exposed above the hull surface for removably suspending a fender from the hull via a fender line tied thereto, and wherein the mounting portion has a width defined by its cross-section and the apparatus has a maximum width defined by a projection of the tie-down portion over the mounting portion.

In an embodiment of the invention, the cylindrical part is oriented along a central axis and the tie-down portion has a length and width, wherein the tie-down portion is longer than it is wide and the tie-down portion length is oriented along or parallel to the central axis. In another embodiment the tie-down portion is oriented generally parallel to the central axis or at an acute angle to the axis.

Preferably the rod and cleat cooperate such that the apparatus has a total length, wherein the apparatus can be stored in a stored position on an elongate flat surface that is at least as long as the total length when the cylindrical part is oriented essentially parallel to the elongate flat surface in the stored position. This is adventurous in permitting compact storage thereof as opposed to the less efficient storage of a T-shaped configuration.

BRIEF DESCRIPTION OF THE DRAWINGS

These and further embodiments of the invention will hereinafter be described in conjunction with the appended drawings provided to illustrate and not to limit the invention, where like designations denote like elements, and in which.

DETAILED DESCRIPTION OF PREFERRED EMBODIMENTS

Figure 2:
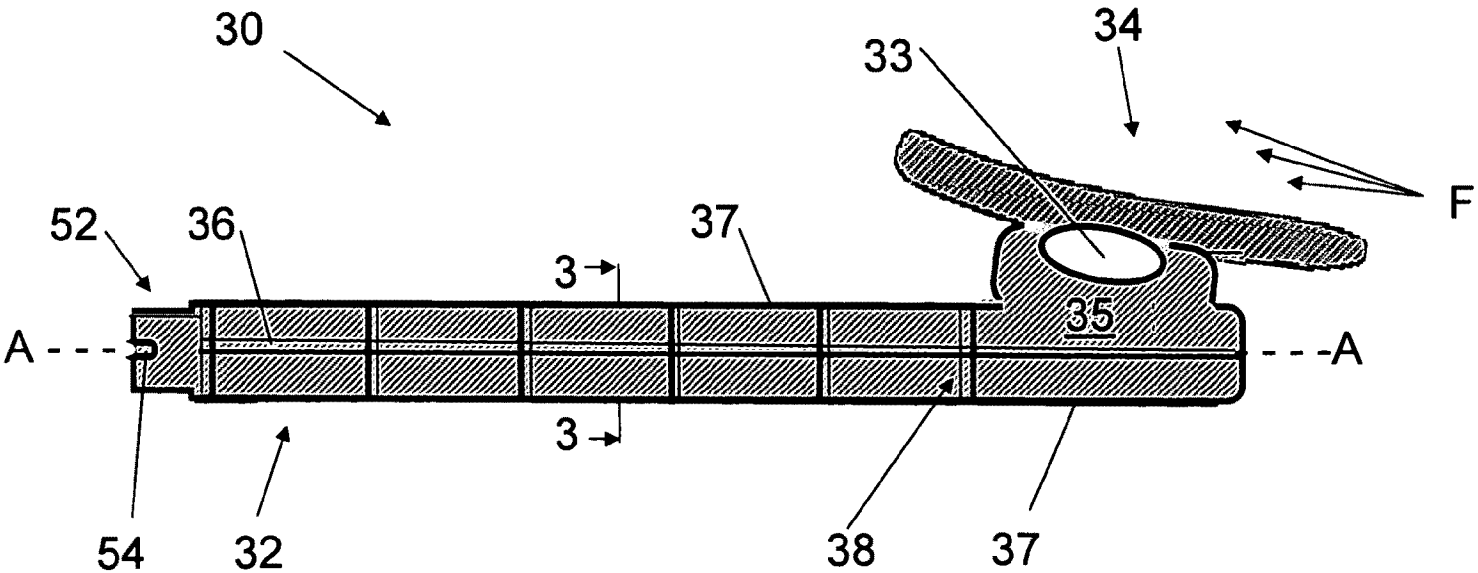
FIG. 2 is a side view of an embodiment of a cleat-rod apparatus of the present invention.

Referring now to FIG. 2, a preferred embodiment of the present invention provides a cleat-rod apparatus 30, having rod member 32 and cleat member 34 formed as a single part. Rod member 32 is for sliding engagement within a cylindrical rod-receiving member 24 of a conventional fishing rod holder 22, wherein fender 10 can be suspended forward of the boat stern as needed to protect the hull from damage.

Preferably cleat-rod apparatus 30 is formed as a single elongate composite part by injection molding or the like, defining an integral rod member 32 and cleat member 34. As a molded part, there is no significant difference in material composition of, and no parting line between, rod member 32 and cleat member 34. As a result of this molding process, there are no welds, screws, bolts or fasteners that can wear or can be over-stressed and fail in practice of the invention. Cleat member 34 is formed as part of and an extension of rod member 32 and reaches out on one side of cleat-rod apparatus 30.

Figure 3:
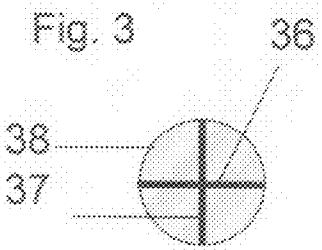
FIG. 3 is a cross-sectional view of the rod member of FIG. 2 taken through line 3-3.

Cleat-rod apparatus 30 can be molded as a solid part without relief. In a preferred embodiment, the weight and cost of cleat-rod apparatus 30 is controlled by forming rod member 32 with reliefs, such as having elongated ribs 36, 37 with formed disks 38 supporting the ribs at intervals, as shown in FIG. 3. The resulting part is lighter than if solid, and, by using less material, is less expensive.

Figure 1:
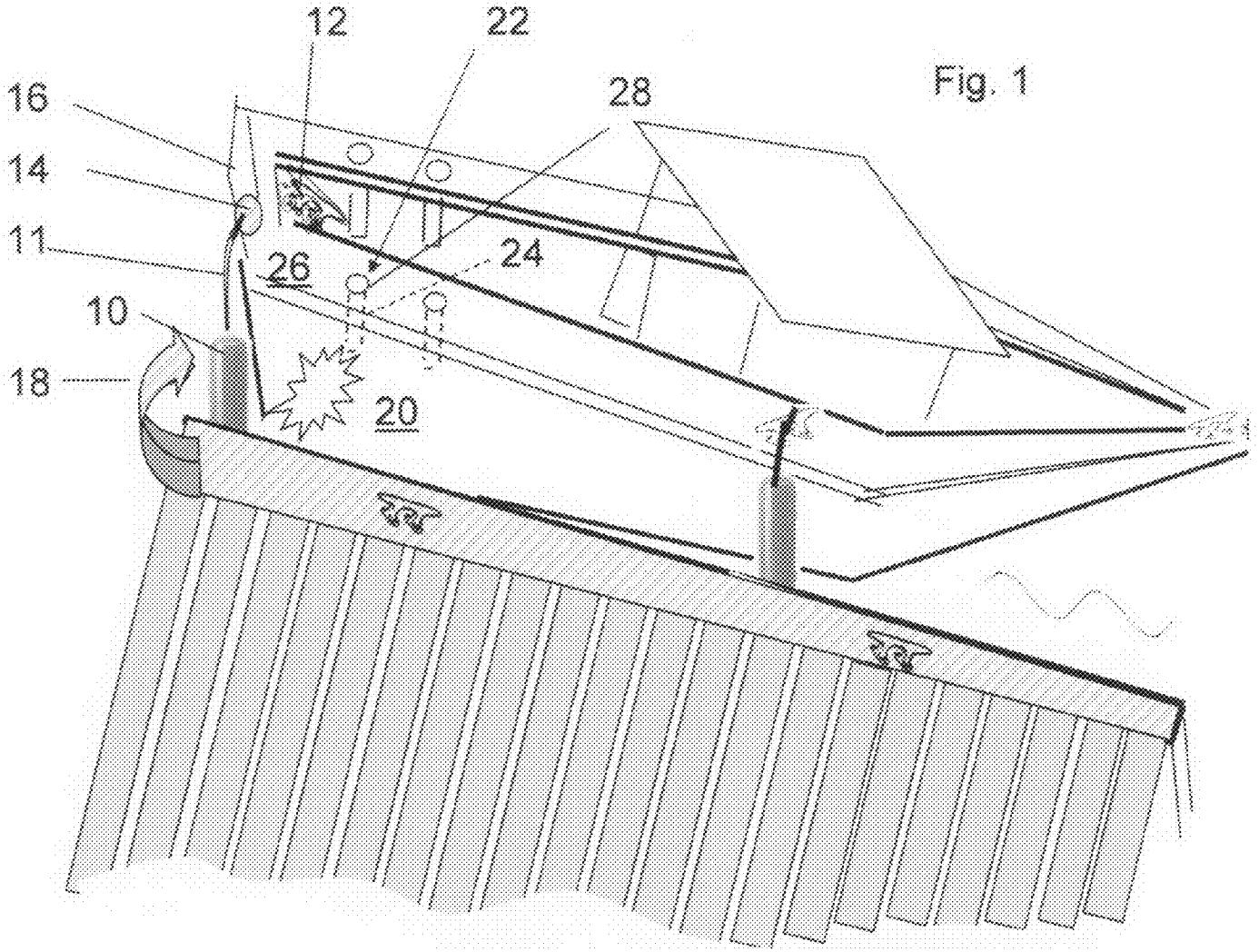
FIG. 1 is a perspective view of a conventional sport boat at dockside.
Figure 5:
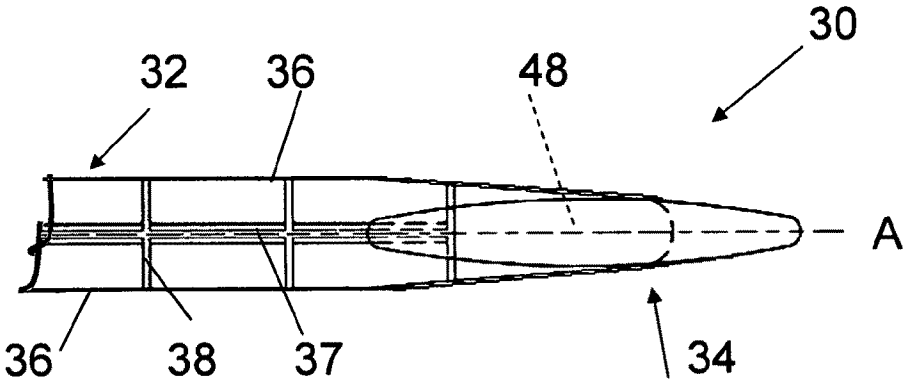
FIG. 5 is a partial side view of the embodiment of FIG. 2, rotated 90 degrees.
Figure 4:
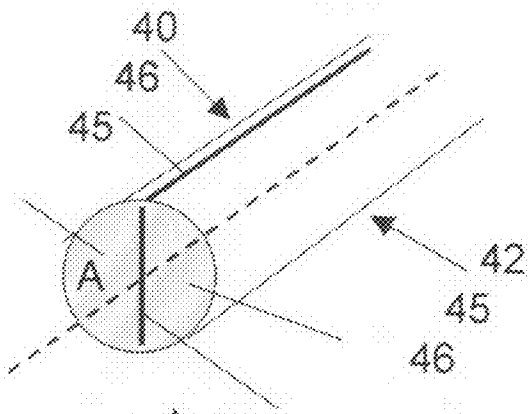
FIG. 4 is a partial perspective view of a mold used in practice of the invention.

Turning to FIG. 4, in one embodiment using conventional molding technology, two halves 40, 42 of a mold 44 are charged with carbon fiber material 45 and are processed and mated to form the molded cleat-rod apparatus 30 of FIG. 2. In doing so, a mating plane 46 is formed where the two charges of material 45 meet and bond during the molding process. Plane 46 has the potential to be a fault line within the formed part. Consequently, plane 42 is intentionally oriented within the part so as to be incidental to the function of the invention. Thus plane 46 has an orientation which is generally parallel to the direction in which forces F applied to the cleat do not cause separation of the mated charges of material 45. The risk of failure of the formed part at plane 46 is thus minimized in normal use. As indicated by dotted line 48 in the partial view of FIG. 5, this plane 46 preferably is oriented to bisect cleat-rod apparatus 30 through the center of ribs 37 and cleat member 34 along the length of the apparatus.

An eyelet 33 is defined at cleat member 34 for feeding of a fender line 11 therethrough. As will be appreciated by a person skilled in the art, the material strength of the formed part will be reflected in material selection. Therefore preferably material section 35 immediately below eyelet 33 is sized in view of forces F applied by a tied on fender, so as to further assure a robust part.

Figure 6:
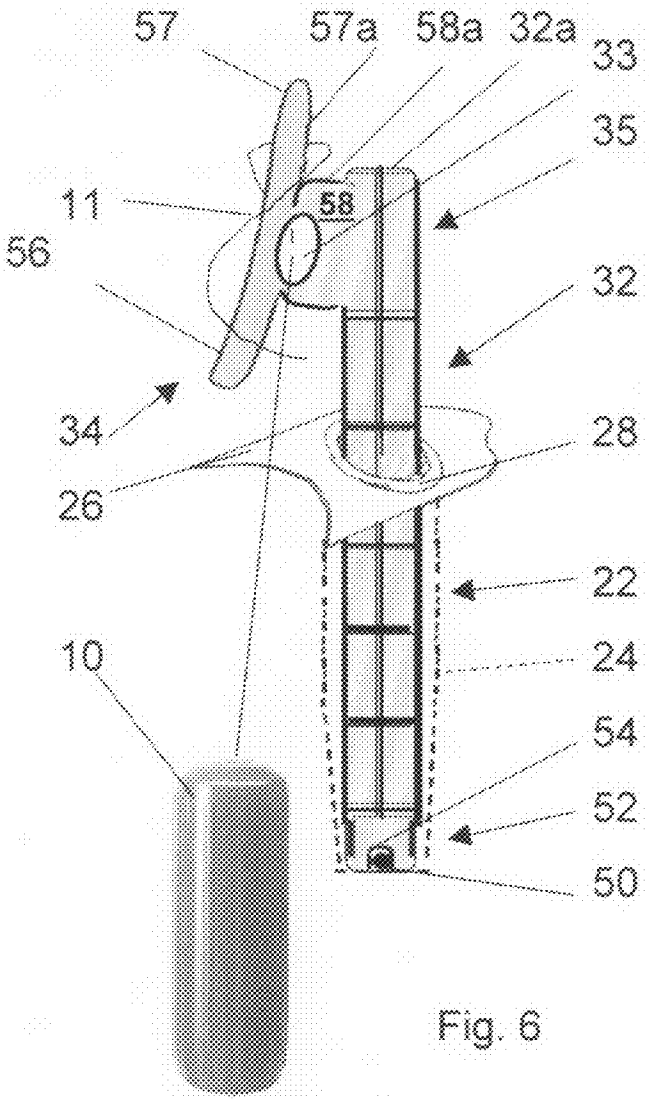
FIG. 6 is a side view of the embodiment of FIG. 2 installed in a fishing rod holder.

Turning to FIG. 6, it will be appreciated that the conventional fishing rod holder 22 includes mounting pin 50 at the distal end of cylindrical rod-receiving member 24 of the rod holder. Pin 50 is for cooperation with the mounting end of a conventional fishing rod. This mounting end typically is notched and mates over the pin. The pin prevents the rod from rotating in the fishing rod holder. Nevertheless, some fishing rod holders also have a swivel function that can permit rotation of the rod in use. Advantageously, owing to the slim design and absence of sharp edges of the present invention, the cleat-rod apparatus 30 can safely swivel and rotate in a holder without risk of damaging the hull surface, and therefore can be used in any rod holder.

In use, cleat-rod apparatus 30 is installed through orifice 28 in hull surface 26 at the proximal end of fishing rod holder 22. Cylindrical rod member 32 of the apparatus is engaged in cylindrical rod-receiving member 24 of the rod holder 22. With cleat-rod apparatus 30 installed, cleat member 34 is presented for suspension of a fender 10 by line 11 when needed. Preferably line 11 is secured through eyelet 33 and cinched about cleat tines 56, 57 and or neck 58.

Furthermore, the distal end of cylindrical rod member 32 is formed as an adapter 52, having notches 54, similar to a conventional fishing rod, to be mated with fishing rod holder pin 50. There are four equidistant notches 54 (only one notch is shown in FIG. 6). This configuration allows apparatus 30 and thus cleat member 34 to be located at 90 degree orientations as desired, when installed with pin 50 mated in selected notches 54.

The present apparatus is intended for attachment of a fender at any location along the hull where a cleat is not readily available and where a fishing rod-receiving cylinder is available. The cleat-rod apparatus of the invention is loaded into the rod-receiving cylinder and a fender is then suspended at that location to protect the hull. Attachment of a fender inboard rather than at the stern location eliminates the risk of having a fender slip off.

For hanging a fender, it has been found that the mere frictional engagement between the outer surface of the rod member and the inner surface of the rod-receiving cylinder is adequate to hold the apparatus in place even when acted upon by the pull of a fender line attached to the cleat member during use.

In use, one simply inserts the apparatus into any rod holder and then ties on a fender where it is needed. This can be done almost instantaneously. The apparatus works well for attachment of a fender. The cleat-rod apparatus is not intended for mooring, but might assist in an emergency.

This apparatus has a sleek design. As a result, it is unobtrusive both in use and as installed. A first step in this design is elimination of the flat plate used to secure a cylindrical rod and cleat, in the so-called T-shape, as in the prior art. Without a flat plate, the apparatus is sleek. As well, the major axis of the cleat member is generally aligned with the major axis of the rod member. Without a T-connection and with the cleat member so aligned relative to the rod member, the apparatus can be easily stored in a tight space.

In the present invention, the apparatus as installed can be lifted and rotated and reseated without fear of damaging or scratching the hull, as might occur when rotating a T-shaped device. This may occur, for example, when the rod-receiving cylinder is at an angle to the hull surface such that an edge of the T-plate can be rotated into contact with the hull.

Figure 7:
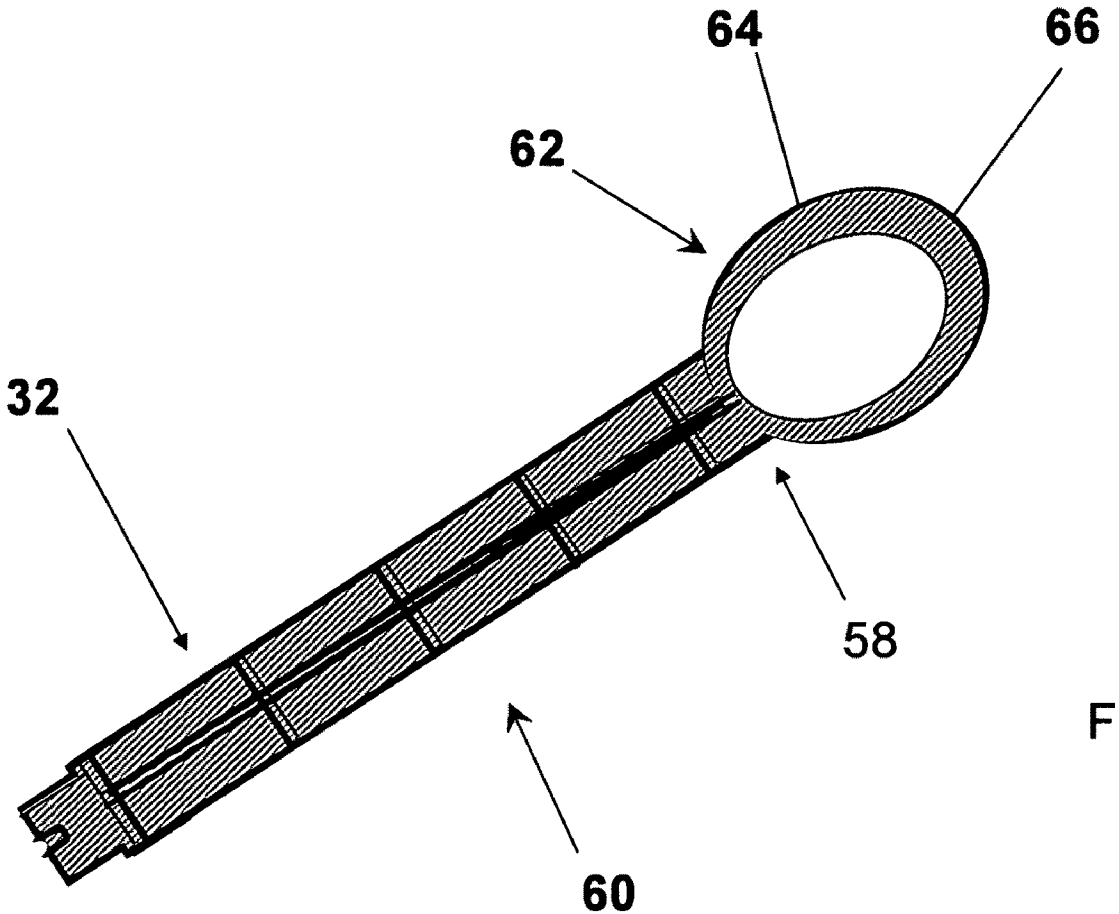
FIG. 7 is a side view of an alternative embodiment of the invention having a yoke with eyelet.

In another embodiment of the invention, an integrated fender-line tie-down apparatus includes a yoke with an eyelet. As shown in one embodiment in FIG. 7, cleat-rod apparatus 60 includes cylindrical rod portion 32 and a yoke portion 62 having an internal eyelet 64 with open center 66 for tying a fender line and preferably cinched about neck 58.

While cleat-rod apparatus 30 may be installed and used as a temporary fender tie-down, it also has an additional use of note. Returning again to the installed embodiment of FIG. 6, it will be appreciated that a support 68 is formed by cooperation of the end 32*a* of rod 32, the recessed upper side 58*a* of neck 58, and back side 57*a* of tine 57.

In use, to assist with a large catch, cleat-rod apparatus 30 is installed in an available fishing rod holder, rapidly as the need arises. This quickly enables a fishing rod to be laid across support 68 and to be stabilized thereby.

While preferred embodiments of the invention have been illustrated and described, it will be clear that the invention is not limited to these embodiments. Numerous modifications, changes, variations, substitutions and equivalents will be apparent to those skilled in the art without departing from the spirit and scope of the invention as described in the claims. For example, although cleat-rod apparatus 30 is depicted having a particular cleat structure, other fastening structures could be employed, including, but not limited to, c-cleats, cam cleats, fairlead-type cleats, padeye-type cleats and the like. Furthermore, alternative types of attachments could be employed for anchoring the cylindrical rod member to the cylindrical rod-receiving member without deviating from the function and purpose of the invention.

What is claimed as new and desired to be protected by Letters Patent is set forth in the appended claims.

What is claimed is:

1. A portable fender-line tie-down apparatus for use with a fishing rod holder mounted in a boat hull, said holder defining a rod-receiver that extends within the hull, the rod-receiver having an inner dimension for receipt and holding of the end of a fishing rod, said apparatus comprising: A) a cleat-rod having B) a rod member, wherein said rod member has a distal end with an outer dimension for insertion and holding in said rod-receiver, C) a cleat member, wherein said cleat member is formed as part of said rod member, and D) wherein said cleat member and rod member cooperate to define a neck, wherein said neck is tapered such that a line tightly tied thereto cannot be slid up and over and off of said cleat member.

2. Apparatus of claim 1 wherein said cleat-rod is a unitary molded part and does not have post-processing fasteners joining said rod member and said cleat member.

3. Apparatus of claim 1 wherein said cleat member has an internal pass-through for feeding of a line to assist in securing of a fender tie-line thereto for suspension of a fender from said cleat member to hang along side the exterior of said hull.

4. Apparatus of claim 1 wherein said apparatus has a total length, wherein said apparatus can be stored in a stored position on an elongate flat surface that is at least as long as said total length, wherein said rod member is oriented essentially parallel to said elongate flat surface in said stored position.

5. Apparatus of claim 1 wherein said fishing rod holder is of the type that has a pin at its base, wherein said cleat-rod has a distal end defining a part for mating with said pin when said apparatus is installed in said holder.

6. Apparatus of claim 1 wherein said cleat-rod is a unitary molded part, wherein said cleat member has a shaped mass which enables tying of a fender tie-line thereto, wherein said cleat-rod can be seated in four positions in said receiver and wherein said shape favors one of said positions.

7. A portable fender-line tie-down apparatus for use with a fishing rod holder mounted in a boat hull, said holder defining a rod-receiver that extends within the hull, the rod-receiver having an inner dimension for receipt and holding of the end of a fishing rod, said apparatus comprising: A) a cleat-rod having B) a rod member, wherein said rod member has a distal end with an outer dimension for insertion and holding in said rod-receiver, C) a cleat member, wherein said cleat member is formed as part of said rod member, and D) wherein said cleat member and rod member cooperate to define a neck, wherein said neck is tapered and forms a support for a fishing rod to be placed thereat.

8. Apparatus of claim 7 wherein said cleat-rod is a unitary molded part and does not have post-processing fasteners joining said rod member and said cleat member.

9. Apparatus of claim 7 wherein said cleat member defines an internal pass-through for feeding of a line to assist in securing of a fender tie-line thereto for suspension of a fender from said cleat member to hang along side the exterior of said hull.

10. Apparatus of claim 7 wherein said apparatus has a total length, wherein said apparatus can be stored in a stored position on an elongate flat surface that is at least as long as said total length, wherein said rod member is oriented essentially parallel to said elongate flat surface in said stored position.

11. Apparatus of claim 7 wherein said fishing rod holder is of the type that has a pin at its base, wherein said cleat-rod has a distal end defining a part for mating with said pin when said apparatus is installed in said holder.

12. Apparatus of claim 7 wherein said cleat-rod is a unitary molded part, wherein said cleat member has a shaped mass which enables tying of a fender tie-line thereto, wherein said cleat-rod can be seated in four positions in said receiver and wherein said shape favors one of said positions.

13. A portable fender-line tie-down apparatus for use with a fishing rod holder mounted in a boat hull, said holder defining a rod-receiver that extends within the hull, the rod-receiver having an inner dimension for receipt and holding of the end of a fishing rod, said apparatus comprising: A) a cleat-rod having B) a rod member, wherein said rod member has a distal end with an outer dimension for insertion and holding in said rod-receiver, C) a cleat member, wherein said cleat member is formed as part of said rod member, and D) wherein said cleat member is formed at one end of said apparatus and said cleat member has tines, at least one said tine extending beyond the end of said rod member, wherein the length of said apparatus is defined by the length of said rod member plus the length of said extension.

14. Apparatus of claim 13 wherein said cleat-rod is a unitary molded part and does not have post-processing fasteners joining said rod member and said cleat member.

15. Apparatus of claim 13 wherein said cleat member has an internal pass-through for feeding of a line to assist in securing of a fender tie-line thereto for suspension of a fender from said cleat member to hang along side the exterior of said hull.

16. Apparatus of claim 13 wherein said apparatus has a total length, wherein said apparatus can be stored in a stored position on an elongate flat surface that is at least as long as said total length, wherein said rod member is oriented essentially parallel to said elongate flat surface in said stored position.

17. Apparatus of claim 13 wherein said fishing rod holder is of the type that has a pin at its base, wherein said cleat-rod has a distal end defining a part for mating with said pin when said apparatus is installed in said holder.

18. Apparatus of claim 13 wherein said cleat-rod is a unitary molded part, wherein said cleat member has a shaped mass which enables tying of a fender tie-line thereto, wherein said cleat-rod can be seated in four positions in said receiver and wherein said shape favors one of said positions.

* * * * *